US010650664B2

(12) United States Patent
Pham et al.

(10) Patent No.: US 10,650,664 B2
(45) **Date of Patent: *May 12, 2020**

(54) FALL DETECTION ALERT/ALARM DEVICE AND METHOD

(71) Applicant: HONEYWELL INTERNATIONAL INC., Morris Plains, NJ (US)

(72) Inventors: Hai Pham, Eden Prairie, MN (US); Steve Huseth, Plymouth, MN (US); Gina Marie Theisen, Blaine, MN (US); Steven James McPherson, Richfield, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/543,804

(22) Filed: Aug. 19, 2019

(65) Prior Publication Data

US 2019/0371159 A1 Dec. 5, 2019

Related U.S. Application Data

(63) Continuation of application No. 16/251,613, filed on Jan. 18, 2019, now Pat. No. 10,431,072, which is a continuation of application No. 16/067,441, filed as application No. PCT/US2016/064332 on Dec. 1, 2016, now Pat. No. 10,223,898.

(Continued)

(51) Int. Cl.

| | |
|---|---|
| ***G08B 25/01*** | (2006.01) |
| ***A62B 35/00*** | (2006.01) |
| ***A62B 35/04*** | (2006.01) |

(52) U.S. Cl.

CPC ..... *G08B 25/016* (2013.01); *A62B 35/0018* (2013.01); *A62B 35/0025* (2013.01); *A62B 35/04* (2013.01)

(58) Field of Classification Search

CPC ..... A62B 35/0018; A62B 35/0031; A62B 35/0037; G08B 25/016; G09G 2320/0223; G09G 2320/0252; G09G 3/3677; Y10T 24/4764

See application file for complete search history.

(56) References Cited

U.S. PATENT DOCUMENTS

| | | | | |
|---|---|---|---|---|
| 2006/0113147 | A1 | 6/2006 | Harris, Jr. | |
| 2010/0231402 | A1* | 9/2010 | Flynt | A62B 35/0025 340/679 |

(Continued)

OTHER PUBLICATIONS

Intenational Search Report and Written Opinion for international application PCT/US2016/064332 dated Mar. 2, 2017.

(Continued)

*Primary Examiner* — Omeed Alizada

(74) *Attorney, Agent, or Firm* — Alston & Bird LLP

(57) ABSTRACT

A fall detection/fall indicator device (20) that automatically senses when a user (14) of fall protection equipment, such as a fall harness (10), has experienced an arrested fall, the fall harness (10) having an electrical circuit (45) that is a closed circuit (46) in a first state and an open circuit (48) in a second state after an arrested fall, and an alert device (62) that is automatically responsive to the open circuit (48) to emit an alert/alarm to other personnel that an arrested fall has been experienced.

25 Claims, 4 Drawing Sheets

Related U.S. Application Data

(60) Provisional application No. 62/273,853, filed on Dec. 31, 2015.

(56) References Cited

U.S. PATENT DOCUMENTS

| | | | | |
|---|---|---|---|---|
| 2010/0231492 | A1 | 9/2010 | Moon et al. | |
| 2012/0050036 | A1* | 3/2012 | Landry | A62B 35/0018 340/540 |
| 2012/0228056 | A1 | 9/2012 | Lang et al. | |
| 2015/0182767 | A1 | 7/2015 | Wise | |
| 2016/0150360 | A1* | 5/2016 | Pope | H04W 4/029 340/8.1 |

OTHER PUBLICATIONS

Notice of Allowance for U.S. Appl. No. 16/067,441, dated Jan. 11 2019, 8 pages.
Notice of Allowance for U.S. Appl. No. 16/067,441, dated Jan. 9, 2019, 13 pages.
Notice of Allowance for U.S. Appl. No. 16/251,613, dated May 20, 2019, 8 pages.

* cited by examiner

FALL DETECTION ALERT/ALARM DEVICE AND METHOD

CROSS-REFERENCE TO RELATED APPLICATIONS

This application is a continuation of U.S. application Ser. No. 16/251,613, filed on Jan. 18, 2019, titled "Fall Detection Alert/Alarm Device And Method," which is a continuation of U.S. application Ser. No. 16/067,441, filed on Jun. 29, 2018, which is a national phase entry of Application No. PCT/US/2016/064332, filed Dec. 1, 2016, which claims priority to U.S. Provisional Application No. 62/273,853, filed Dec. 31, 2015, the entire contents of each of which are hereby incorporated by reference in their entirety for all purposes.

FEDERALLY SPONSORED RESEARCH OR DEVELOPMENT

Not Applicable.

MICROFICHE/COPYRIGHT REFERENCE

Not Applicable.

FIELD

This disclosure relates to personal protective equipment (PPE) and more particularly to fall protection equipment (FPE), and even more particularly to fall indicators/fall detection devices as used in connection with fall harnesses and other fall protection equipment.

BACKGROUND

Fall harnesses are an example of a critical piece of fall protection safety equipment that are integral to preventing accidents on the job site. They provide a reliable restraint system worn by the worker that is connected to a fixed anchor point on a supporting structure. Fall harnesses are designed to arrest the fall of a worker quickly and safely but result in the worker being suspended in the fall harness. If there is no ladder or scaffolding for the worker to climb back up, the worker will remain suspended until additional rescue help can be rendered. Being suspended in the fall harness for an extended period of time can lead to serious injury or death. Consequently, rapid response is critical.

It is known to provide a fall indicator in a fall harness to provide notice that a fall harness has experienced a arrested fall while worn by worker, with the fall indicator being formed by a folded length of one of the straps that forms the fall harness that is secured in the folded condition by a breakable connection that breaks when the harness experiences an arrested fall while worn by a worker. Typically, such fall indicators have a label or other indicia that is exposed when the breakable connection is broken and the folded length of strap unfolds, with the now exposed label or other indicia providing notice that the harness has experienced an arrested fall. While the notice provided by the label/indicia is useful for preventing future use of the harness without understanding that the harnesses already experienced an arrested fall, the label/indicia does nothing to alert other personnel that a worker has experienced an arrested fall and may be suspended in the fall harness.

SUMMARY

A fall detection/fall indicator device is provided that automatically senses when a user of fall protection equipment, such as a fall harness, has experienced an arrested fall and capable of providing an alarm/alert to other personnel so that they may provide assistance to the user in a timely fashion.

In accordance with one feature of this disclosure, a fall harness is provided for use in fall protection. The fall harness includes a plurality of straps configured to attach the harness to a user and to other fall protection equipment. The harness further includes a fall indicator having a first state wherein the harness has not experienced an arrested fall, and a second state wherein the harness has experienced an arrested fall while worn by a user. The fall indicator includes a length of one of the straps, the length having a folded condition in the first state wherein the length is folded upon itself and maintained in the folded condition by a connection that breaks in response to the harness experiencing an arrested fall while worn by a user, and an unfolded condition in the second state wherein the connection is broken and the length unfolded in response to an arrested fall experienced by the harness while worn by a user. The fall indicator further includes an electrical connection having a pair of electrical contacts that are contacted together to form a closed circuit in the first state and that are spaced from each other in the second state to form an open circuit. The contacts are mounted on the length of strap so that the contacts face each other in adjacent portions of the length of strap in the folded condition and are contacted together to form the closed circuit, and so that the contacts are spaced from each other with the length of strap in the unfolded condition to form the open circuit. The fall indicator further includes an alert device operably connected to the electrical connection and responsive to the open circuit to provide an alert to other personnel that the fall indicator is in the second state after the harness experiences an arrested fall while worn by a user.

As one feature, the electrical connection includes a snap fastener having a post component defining one of the contacts, and a socket component defining the other contact and configured to releasably receive the post component.

In one feature, a processing unit is operably connected to the electrical connection to detect the open circuit and to the alarm device to initiate the alert in response to detection of the open circuit. According to a further feature, the processing unit is a microprocessor unit. As one feature, a housing mounts at least one of the processing unit and the alert device to the harness. In a further feature, the housing is fixed on the length of strap.

According to one feature, the alert device is configured to emit an audible acoustic alert. As a further feature, the alert device includes a siren device.

In one feature, the alert device is configured to emit a visual alert. According to a further feature, the alert device includes a strobe light device.

As one feature, the alert device is configured to emit a wireless signal that can be detected by a device remote from the harness to alert the device that the fall indicator is in the second state. In a further feature, the alert device includes a wireless transmitter.

According to one feature, the harness includes at least one more fall indicator.

As one feature, a method of providing an alert that a piece of fall protection equipment has experienced an arrested fall while worn or used by a user is provided. The piece of fall protection equipment including a fall indicator having a first state wherein the piece of fall protection equipment has not experienced an arrested fall, and a second state wherein the piece of fall protection equipment has experienced an arrested fall while worn or used by a user. The method includes the steps of electronically detecting a change of the fall indicator from the first state to the second state, and automatically initiating an alert in response to the step of electronically detecting.

In one feature, the step of electronically detecting includes creating an open circuit in response to the change of the fall indicator from the first state to the second state.

According to one feature, a method of providing an alert that a piece of fall protection equipment has experienced an arrested fall while worn or used by a user is provided. The method includes the steps of providing the piece of fall protection equipment with an electrical circuit that is closed in a first state wherein the piece of fall protection equipment has not experienced an arrested fall, and that is open in a second state wherein the piece of fall protection equipment has experienced an arrested fall while worn or used by a user, and automatically initiating an alert in response to the open circuit.

As one feature, a fall indicator is provided for use on a piece of fall protection equipment to provide an alert to other personnel that a worker using or wearing the piece of fall protection equipment has experienced an arrested fall. The fall indicator has a first state wherein the piece of fall protection equipment has not experienced an arrested fall, and a second state wherein the harness has experienced an arrested fall while worn or used by a worker. The fall indicator includes a length of strap, the length having a folded condition in the first state wherein the length is folded upon itself and maintained in the folded condition by a connection that breaks in response to the piece of fall protection equipment experiencing an arrested fall, and an unfolded condition in the second state wherein the connection is broken and the length unfolded in response to an arrested fall. The fall indicator further includes an electrical connection having a pair of electrical contacts that are contacted together to form a closed circuit in the first date and that our spaced from each other in the second state to form an open circuit. The contacts are mounted on the length of strap so that the contacts face each other in adjacent portions of the length of strap in the folded condition and are contacted together to form the closed circuit, and so that the contacts are spaced from each other with the length of strap in the unfolded condition to form the open circuit. The fall indicator further includes an alert device operably connected to the electrical connection and responsive to the open circuit to provide an alert to other personnel that the fall indicator is in the second state after the piece of fall protection equipment experiences an arrested fall.

Other features and advantages will become apparent from a review of the entire specification, including the appended claims and drawings.

DETAILED DESCRIPTION

Figure 1:
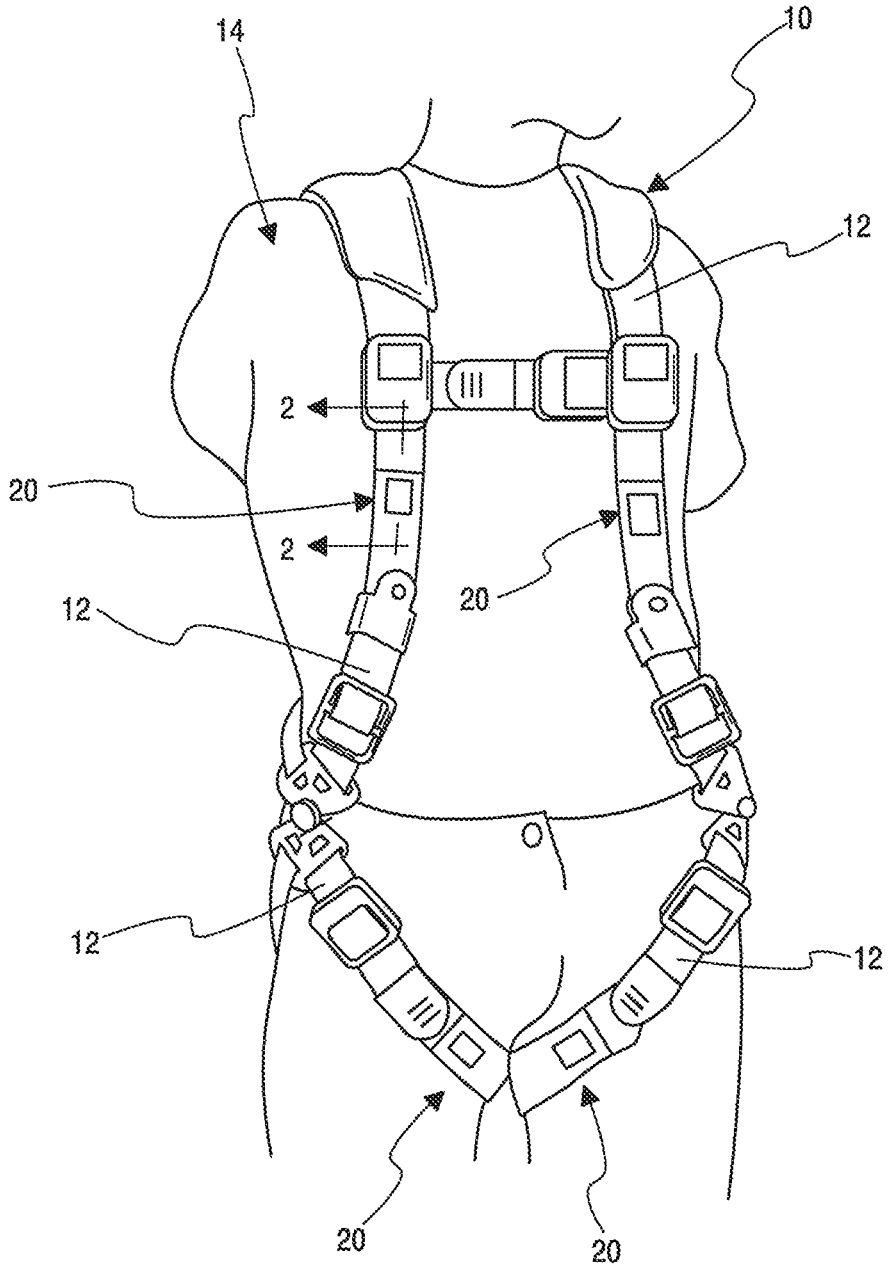
FIG. 1 is a somewhat diagrammatic representation of a fall harness employing a fall detection/fall indicator device according to this disclosure.

With reference to FIG. 1, an item of personal protective equipment (PPE) for providing fall protection is shown as a piece of fall protection equipment (FPE) in the form of a safety/fall harness 10 for use in fall protection. The safety harness includes a plurality of straps 12 configured to attach the harness 10 to a worker/user 14 and to other fall protection equipment, such as, for example, an anchor, a fall protection lanyard, or a self retracting lifeline. It should be understood that many types and configurations of safety/fall harnesses are known in the PPE and FPE industry, including full body harnesses and partial or hip/waist fall harnesses, all, or most, of which are suitable for use with the concepts disclosed herein, accordingly, the harness depicted in FIG. 1 is for purposes of illustration and further specific details of the fall harness 10 will not be discussed herein except for those required for an understanding of the disclosed concepts, and that the appended claims are not limited to any specific details of a fall harness unless expressly recited in the claims.

One or more fall protection/fall indicator devices 20 are provided at one or more corresponding key locations on the harness 10 where the harness 10 will experience a shock load when a user 14 of the harness 10 experiences an arrested fall. Each of the fall indicators 20 has a first state wherein the user 14 and the harness 10 have not experienced an arrested fall, and a second state wherein the user 14 and the harness 10 have experienced an arrested fall. In the second state, each of the fall indicators 20 provide an alarm/alert to other personnel that the user 14 has experienced an arrested fall, thereby enabling such personnel to provide assistance to the user 14 in a timely fashion. Because fall harnesses are well known and because they can be, and are, provided in a number of different configurations with different details that are compatible with the concepts of this disclosure, and further because the details of the safety harness 10 outside of the fall indicator 20 are not critical to understanding the fall indicator 20 and the method according to this disclosure, further details of the harness 10 outside of the fall indicator 20 will not be provided herein.

Figure 2A:
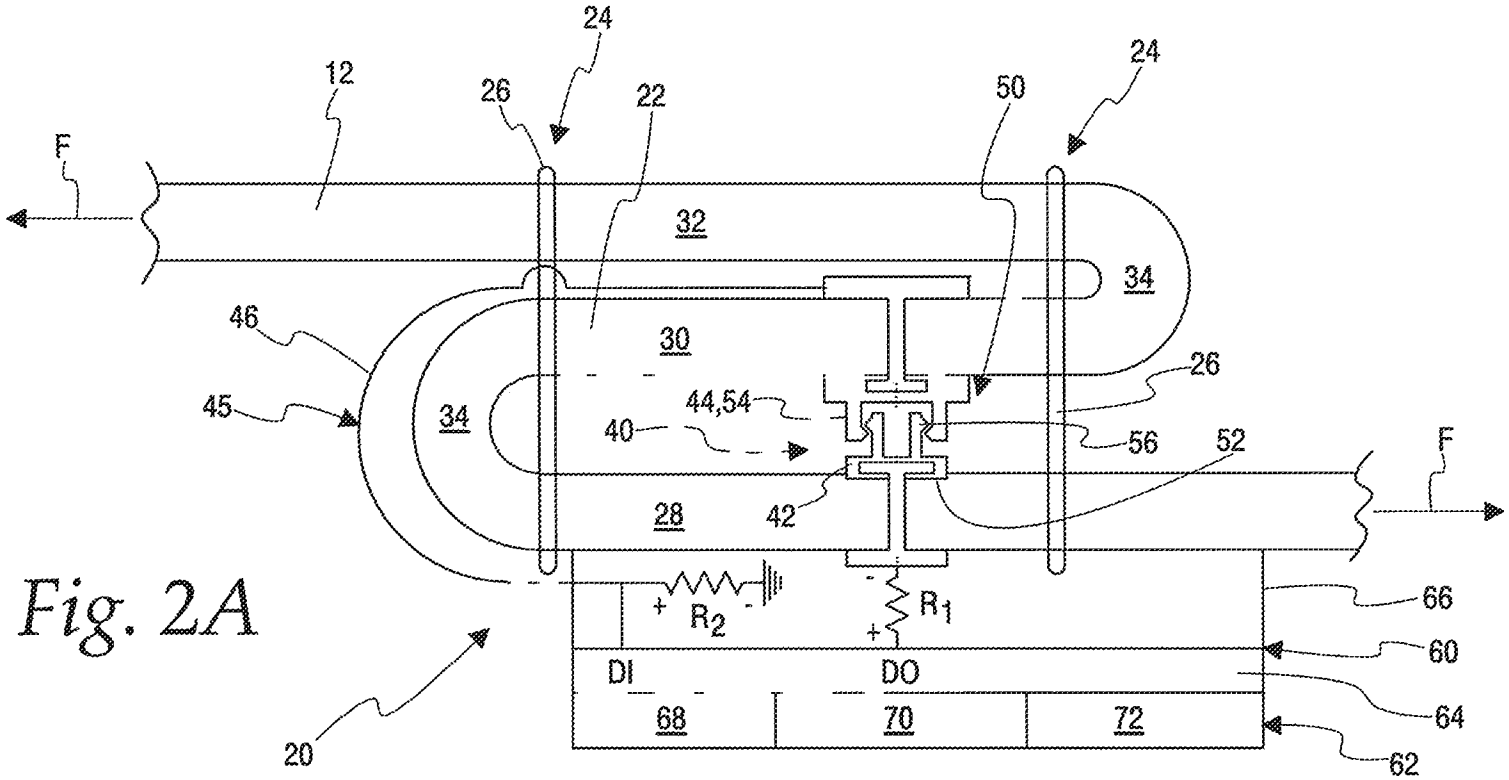
FIGS. 2A and 2B are enlarged, somewhat diagrammatical, section views take him along line 2-2 in FIG. 1 and showing details of the fall detection/fall indicator device according to this disclosure, with FIG. 2A showing the fall indicator device in a first state/folded condition and FIG. 2B showing the fall indicator device in a second state/unfolded condition.
Figure 2B:
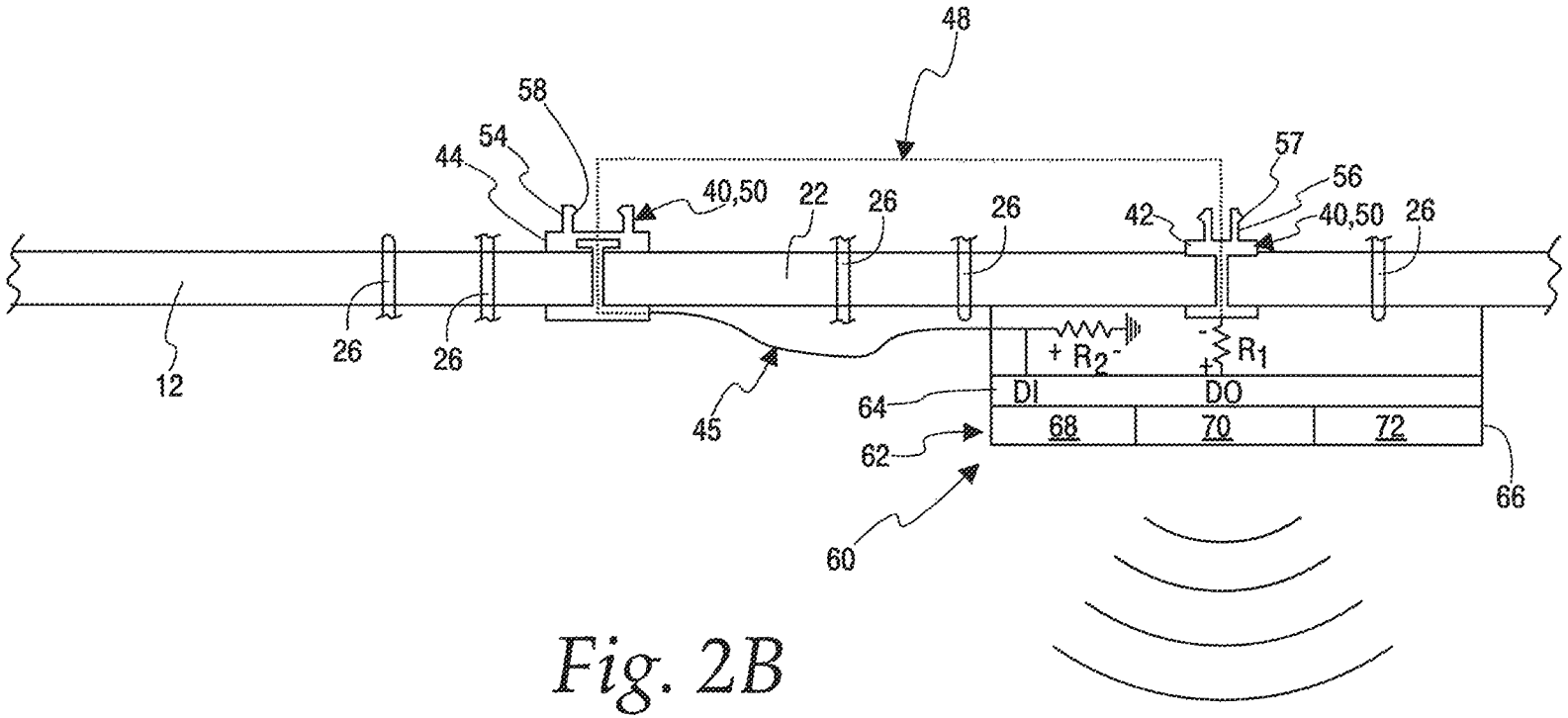

FIGS. 2A and 2B show the details of one of the fall indicators 20, and it should be understood that these details are consistent for all of the fall indicators 20 provided on the harness 10. The fall indicator 20 includes a length 22 of one of the straps 12, the length 22 having a folded condition in the first state shown in FIG. 2A wherein the length 22 is folded upon itself and maintained in the folded condition by a breakable or releasable connection 24 that breaks or releases in response to the harness 10 and the user 14 experiencing an arrested fall, and an unfolded condition in the second state shown in FIG. 2B wherein the connection 24 is broken and the length 22 unfolded in response to an arrested fall experienced by the harness 10 in the user 14.

In the illustrated embodiment, the connection 24 is provided in the form of two spaced lines of stitching 26 that extend through and connect adjacent portions 28, 30, and 32 of the length 22 at folds 34 of the fall indicator 20 in the folded condition. As is known, proper selection of materials and stitch configuration will allow the lines of stitching 26 to break when the length 22 of strapping 12 experiences a predetermined tensile shock load F that corresponds to the expected load that will be experienced during an arrested fall. It should be appreciated that while the illustrated embodiment shows the connection 24 in the form of the pair of spaced lines of stitching 26 other suitable forms of the connection 24 are contemplated within the scope of this disclosure, such as, for example, a single line of stitching, bonding agents or adhesive, and/or one or more breakable/releasable rivet connections.

The fall indicator 20 includes an electrical connection 40 having a pair of electrical contacts 42 and 44 that are part of an electrical circuit, shown schematically at 45 in FIGS. 2A and 2B. The electrical contacts 42 and 44 are connected together to form a closed circuit, shown schematically at 46 in FIG. 2A, in the first state and folded condition, and that are spaced from each other in the second state and unfolded condition to form an open circuit, shown schematically at 48 in FIG. 2B. The contacts 42 and 44 are mounted on the length 22 of strap 12 so that the contacts 42 and 44 face each other in adjacent portions 28 and 30 of the length 22 in the folded condition and are contacted together to form the closed circuit 46, as shown in FIG. 2A, and so that the contacts 42 and 44 will be spaced from each other to form the open circuit 48 when the length 22 of strap 12 is in the unfolded condition, as shown in FIG. 2B.

In the illustrated embodiment, the electrical connection 40 is provided in the form of an electrically conductive snap fastener 50 having an electrically conductive post component 52 defining one of the contacts 42 and an electrically conductive socket component 54 defining the other of the contacts 44 and configured to releasably receive a post 56 of the post component 52, with the engagement of the post 56 and the socket component 54 forming an electrically conductive connection. Although it is not known for such snap fasteners to be used as an electrical connection, the garment industry is replete with many known suitable, electrically conductive configurations and types of such snap fasteners, any of which may be utilized in the fall indicator 20 according to this disclosure depending upon the particular requirements of each application and, accordingly, the details of the illustrated snap fastener 50 are not important to an understanding of the concepts disclosed and claimed herein and the claims are not limited to any particular detail unless expressly stated in the claims. Having said that, as best seen in FIG. 2B, in the illustrated embodiment of the snap fastener 50, the post 56 includes a detent 57 that is movable past a detent 58 in the socket component 54 due to the resiliency of either the remainder of the post 56 or the remainder of the socket component 54.

In the illustrated embodiment, the fall indicator 20 further includes an electronics module 60 that at least includes an alert device 62 operably connected to the electrical connection 40 and responsive to the open circuit 48 to automatically provide an alert that the fall indicator 20 is in the second state after the harness 10 and the user 14 have experienced an arrested fall.

In the illustrated embodiment, the electronics module 60 further includes a processing unit provided in the form of a microprocessor unit (MPU) 64 operably connected to the electrical connection 40 to automatically detect the open circuit 48 and operably connected to the alert device 62 to automatically initiate the alert in response to detection of the open circuit 48. In this regard, in some embodiments, it will be desirable for the MPU 64 to be a very low power consumption MPU that is configured to wake up periodically to sense the condition of the fall indicator 20. In the illustrated embodiment, the open circuit 48 is detected as a change in voltage at DI in the MPU 64 relative to the closed circuit 46 voltage at DI. In the illustrated embodiment, a housing 66 is fixed on the length 22 of strap 12 and mounts and encloses the alert device 62 and the processing unit 64.

In some embodiments, the alert device 62 is configured to emit an audible acoustic alert/alarm that is detectable by personnel remote from the user 14. In some embodiments, the alert device 62 is configured to emit a visual alert that is detectable by personnel remote from the user 14. In some embodiments, the alert device 62 is configured to emit a wireless signal that can be detected by a device or devices (not shown) remote from the harness 10 and the user 14 to alert the remote device(s) that the fall indicator 20 is in the second state and that the user 14 has experienced an arrested fall. The remote device(s) may be in the form of one or more wireless phones (cell phones) that have a fall detection application software and that are carried by remote personnel, by a receiver that has an embedded acoustic alert device/generator, or/and a relay device that will relay the wireless signal to a cloud server or similar device configured to distribute the wireless signal, including the identification of the fallen user to the fallen user's supervisor and/or rescuers. In some embodiments, the alert device 62 is configured to emit at least two of the visual alert, audible acoustic alert, and wireless signal. In some embodiments, the alert device is configured to emit just one of the visual alert, audible acoustic alert, and wireless signal. In some embodiments, the alert device 62 is configured to emit all three of the visual alert, audible acoustic alert, and wireless signal. In some embodiments wherein the alert device 62 is configured to emit an audible acoustic alert, the alert device 62 will include a siren device 68, of which many suitable types and configurations are known, with a high power siren device 68 capable of producing an 85 dB audible noise being desirable in many applications. In some embodiments wherein the alert device 62 is configured to emit a visual alert, the alert device 62 will include a strobe light device 70, of which many suitable types and configurations are known. It will be desirable in some applications for the strobe light device 70 to be positioned so that it reflects of the material of the strap(s) 12 to further enhance the illumination. In some embodiments wherein the alert device 62 is configured to emit a wireless signal, the alert device 62 will include a wireless transmitter 72, of which many suitable types and configurations are known.

Figure 3:
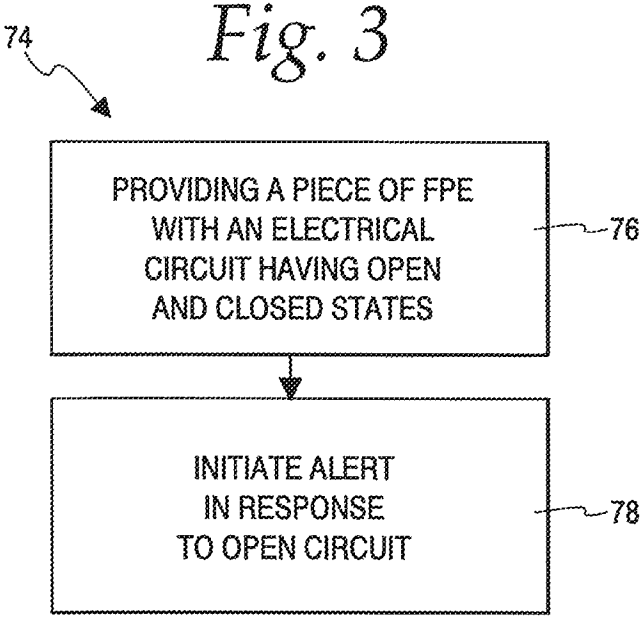

With reference to FIG. 3, a method 74 is shown for providing an alert that a fall harness 10 or other piece of fall protection equipment (FPE) 10 has experienced an arrested fall while worn or used by a user/worker 14. The method includes the step 76 of providing the piece of fall protection equipment 10 with an electrical circuit 45 that is closed in a first state wherein the piece of fall protection equipment 10 has not experienced an arrested fall, and that is open in a second state wherein the piece of fall protection equipment 10 has experienced an arrested fall while worn or used by a user 14. The method 74 further includes the step 78 of automatically initiating an alert in response to the open circuit.

Figure 4:
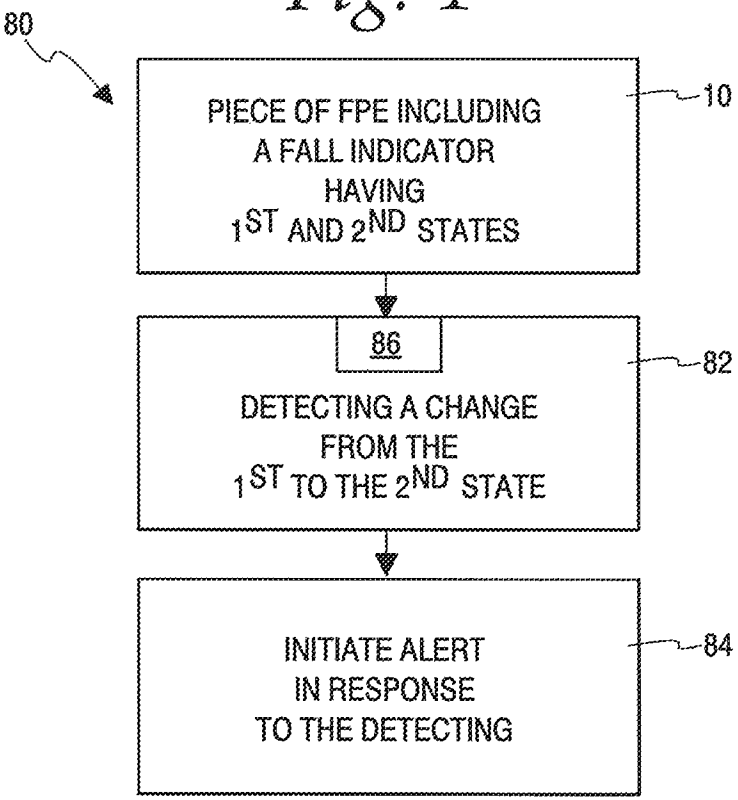
FIGS. 3 and 4 are diagrammatic representations of a method for providing an alert that a user of fall protection equipment has experienced and arrested fall according to this disclosure.

With reference to FIG. 4, a method 80 is shown for providing an alert that a fall harness 10 or other piece of fall protection equipment has experienced an arrested the fall when worn or used by a user 14, the piece of fall protection equipment 10 including a fall indicator 20 having a first state wherein the piece of fall protection equipment 10 has not experienced a fall, and a second state wherein the piece of fall protection equipment 10 has experienced a fall while worn or used by user 14. The method includes the steps of:

electronically detecting 82 a change of the fall indicator 20 from the first state to the second state; and automatically initiating 84 an alert in response to the step on electronically detecting.

In a further embodiment of the method 80, the step 82 of electronically detecting includes creating 86 an open circuit 48 in response to the change of the fall indicator 20 from the first state to the second state.

While several embodiments have been shown and discussed herein, it should be understood that this disclosure contemplates modifications to those embodiments. For example, while the electronics module 60 has been shown as being fixed to the fall indicator 20, the electronics module 60 could be fixed to other portions of the harness 10. As another example, while the electronics module 60 has been shown as being mounted and enclosed in a single housing 66, the electronics module 60 could be mounted and enclosed in multiple housings. As a further example, while the illustrated embodiments show the alert device 62 as being connected to the electrical connection 40 via the MPU 64 and initiated by the MPU 64, other operable connections are contemplated that would initiate the alert device 62 in response to the open circuit 48. As yet a further example, while the illustrated embodiment of the electrical connection 40 is shown in the form of a snap fastener 50, other suitable forms of electrical connections having a pair of electrical contacts that can be connected in the first state and disconnected in the second state are contemplated within the scope of this disclosure. As yet another example, while the fall indicator 20 has been disclosed herein in connection with a fall harness 10, use of the fall indicator 20 with other types of fall protection equipment, such as, for example, fall protection lanyards and SRL's, is contemplated within the scope of this disclosure. As a further example, while the breakable/releasable connection 24 is shown the form of two lines of stitching 26 that extend through three layers of length 22 of strap 12, it is possible for either or both of the lines of stitching 26 to extend only through two layers of the length of strap 12, or for the connection to be a single line of stitching that extends only through two layers of the length of strap 12.

The invention claimed is:

1. A harness for arresting a user's fall, the harness comprising:

a length of strap configured to secure the harness to a securing point a first electrical contact mounted on a first portion of the length of strap and a second electrical contact mounted on a second portion of the length of strap adjacent the first portion such that, when the harness is in a first configuration, the first electrical contact is electrically coupled to the second electrical contact to form a closed circuit and the length of the strap is in folded configuration, and, when the harness is in a second configuration, the first electrical contact is electrically decoupled from the second electrical contact to form an open circuit and the length of the strap is in unfolded configuration; and an alert device operably connected to the first electrical contact and second electrical contact and configured to provide an alert when the harness is transitioned from the first configuration to the second configuration.

2. The harness of claim 1, wherein at least one of the first portion of the length of strap and the second portion of the length of strap is configured to be stretched, moved, unfolded, or deformed in at least one of the first configuration or the second configuration.

3. The harness of claim 2, wherein the at least one of the first portion of the length of strap and the second portion of the length of strap is releasably held in the first configuration.

4. The harness of claim 3, wherein, when a force is applied to the at least one of the first portion of the length of strap and the second portion of the length of strap, the at least one of the first portion of the length of strap and the second portion of the length of strap is configured to transition from the first configuration to the second configuration.

5. The harness of claim 3, wherein, when the at least one of the first portion of the length of strap and the second portion of the length of strap or another accessory of the harness is not properly worn by a wearer, the circuit formed by at least the first electrical contact and the second electrical contact is caused to be opened.

6. The harness of claim 3, further comprising:

a processing unit operably connected to at least one of the first electrical contact and the second electrical contact to detect the open circuit and to the alert device to initiate the alert in response to detection of the open circuit; and a housing mounting at least one of the processing unit and the alert device to the harness.

7. The harness of claim 1, wherein the alert device is configured to emit one or more of an audible acoustic alert and a visual alert.

8. The harness of claim 1, further comprising:

a wireless transponder, wherein the alert device is configured to emit a wireless signal that can be detected by a device remote from the harness to alert the alert device that the harness section length of strap has been transitioned from the first configuration to the second configuration.

9. A harness for arresting a user's fall, the harness comprising:

a length of strap configured to secure the harness to a securing point a first electrical contact supported on a first portion of the length of strap and a second electrical contact supported on a second portion of the length of strap such that, in the first configuration, the first electrical contact is electrically coupled to the second electrical contact through an electrical coupling to form a closed circuit and, in the second configuration, the first electrical contact is electrically decoupled from the second electrical contact to form an open circuit; and an alert device operably connected to the first electrical contact and second electrical contact and configured to provide an alert when the harness is in one of the first configuration and the second configuration.

10. The harness of claim 9, wherein at least one of the first portion of the length of strap and the second portion of the length of strap is configured to be moved or deformed upon transition from the first configuration to the second configuration.

11. The harness of claim 10, wherein the length of strap is releasably held in the first configuration by an electrical coupling.

12. The harness of claim 11, wherein said electrical coupling is configured to be uncoupled in response to a force applied to the length of strap, allowing the length of strap to transition from the first configuration to the second configuration.

13. The harness of claim 11, wherein said first electrical contact is separated from said second electrical contact by said electrical coupling such that, when the harness is worn properly by a wearer, said first electrical contact and said second electrical contact form the closed circuit with the electrical coupling, holding the length of strap in said first configuration.

14. The harness of claim 9, further comprising:

a processing unit operably connected to at least one of the first electrical contact, the second electrical contact, and the electrical coupling to detect the open circuit and to the alert device to initiate the alert in response to detection of the open circuit; and a housing mounting at least one of the processing unit and the alert device to the harness.

15. The harness of claim 9, wherein the alert device is configured to supply an electrical current, through at least one of said first electrical contact and said second electrical contact, to said electrical coupling and back to said alert device, and wherein the alert device is configured to emit at least one of a wireless signal, an audible acoustic alert, and a visual alert when said electrical current is disconnected from said electrical coupling.

16. The harness of claim 9, further comprising:

a wireless transponder, wherein the alert device is configured to receive a wireless signal from a device remote from the harness to alert the alert device that the length of strap has been transitioned from the first configuration to the second configuration.

17. The harness of claim 9, wherein the alert is provided when said first electrical contact and said second electrical contact become electrically disconnected.

18. A harness for arresting a user's fall, the harness comprising:

a length of strap configured to transition from a first conformation to a second conformation;

a first electrical contact and a second electrical contact supported on the length of strap such that, in the first conformation, the first and second electrical contacts form a closed circuit and, in the second conformation, the first and second electrical contacts are electrically decoupled to form an open circuit; and an alert device operably connected to at least one of the first or second electrical contacts and configured to provide an alert when the length of strap is transitioned from the first conformation to the second conformation.

19. The harness of claim 18, wherein the length of strap is configured to be stretched, moved, unfolded, or deformed in order to transition from said first conformation to said second conformation.

20. The harness of claim 19, wherein the length of strap is releasably held in the first conformation by an electrical coupling.

21. The harness of claim 20, wherein said electrical coupling is configured to be uncoupled in response to a force applied to the length of strap, allowing the length of strap to move from the first conformation to the second conformation, further causing said at least one electrical contact to be decoupled, forming said open circuit.

22. The harness of claim 21, wherein said at least one electrical contact forms said closed circuit in said first conformation by being electrically coupled to said electrical coupling.

23. The harness of claim 21, further comprising:

a processing unit operably connected to at least one of the first electrical contact, the second electrical contact, and the electrical coupling, said processing unit configured to detect the open circuit and to the alert device to cause the alert device to provide the alert in response to detection of the open circuit.

24. The harness of claim 18, wherein the alert device is configured to emit at least one of a wireless signal, an audible acoustic alert, and a visual alert.

25. The harness of claim 18, further comprising:

a wireless transponder, wherein the alert device is configured to receive a wireless signal that can be detected by a device remote from the harness to alert the alert device that the length of strap has been transitioned from the first conformation to the second conformation.

* * * * *